US007390583B2

(12) United States Patent
Miyaji et al.

(10) Patent No.: US 7,390,583 B2
(45) **Date of Patent: *Jun. 24, 2008**

(54) SPRAYED COATING AND PRODUCTION METHOD FOR THE SAME

(75) Inventors: Shinya Miyaji, Yokohama (JP); Shinji Saito, Yokohama (JP)

(73) Assignee: NHK Spring Co., Ltd., Kanagawa (JP)

( * ) Notice: Subject to any disclaimer, the term of this patent is extended or adjusted under 35 U.S.C. 154(b) by 416 days.

This patent is subject to a terminal disclaimer.

(21) Appl. No.: 10/751,109

(22) Filed: Jan. 5, 2004

(65) Prior Publication Data

US 2004/0151839 A1 Aug. 5, 2004

(30) Foreign Application Priority Data

Jan. 6, 2003 (JP) ..... 2003-000329

(51) Int. Cl.
*B32B 9/00* (2006.01)

(52) U.S. Cl. ..... 428/701; 428/702; 428/469

(58) Field of Classification Search ..... None
See application file for complete search history.

(56) References Cited

U.S. PATENT DOCUMENTS 4,774,150 A * 9/1988 Amano et al. ..... 428/690
5,350,479 A * 9/1994 Collins et al. ..... 156/345.53
5,773,141 A * 6/1998 Hasz et al. ..... 428/335
5,955,182 A * 9/1999 Yasuda et al. ..... 428/217
5,993,976 A * 11/1999 Sahoo et al. ..... 428/472
6,175,485 B1 * 1/2001 Krishnaraj et al. ..... 361/234
6,306,515 B1 * 10/2001 Goedjen et al. ..... 428/469
6,452,775 B1 * 9/2002 Nakajima ..... 361/234

FOREIGN PATENT DOCUMENTS

| | | |
|---|---|---|
| JP | 62-063664 | 3/1987 |
| JP | 04-333556 | 11/1992 |
| JP | 09-069554 | 3/1997 |
| JP | 10-226869 | 8/1998 |
| JP | 11-260534 | 9/1999 |
| JP | 2000-212717 | 8/2000 |

* cited by examiner

*Primary Examiner*—Jennifer McNeil
*Assistant Examiner*—Timothy M. Speer
(74) *Attorney, Agent, or Firm*—Arent Fox LLP

(57) ABSTRACT

A sprayed coating is proposed in which a problem of a condition of oxygen defect which cannot be solved by conventional densification of the sprayed coating is solved, whereby excellent electrical insulation and corrosion resistance can be simultaneously obtained. A sprayed coating formed by plasma spraying inside a semiconductor processing device comprises a metal oxide or a semiconductor oxide, and composition ratio of oxygen with respect to a metal or a semiconductor which composes oxides, that is (oxygen/(metal or semiconductor)) is not less than 80% of a composition ratio in the case of stoichiometric composition.

5 Claims, No Drawings

SPRAYED COATING AND PRODUCTION METHOD FOR THE SAME

BACKGROUND OF THE INVENTION

1. Field of the Invention

The present invention relates to a sprayed coating formed inside a semiconductor processing device and relates to a production method for the same, and in particular, relates to a production technique for producing a sprayed coating in which excellent electrical insulation and corrosion resistance are simultaneously obtained.

2. Description of Related Art

When a deposit is formed on metallic material by ceramic-spray forming, heat resistance, electrical insulation, and corrosion resistance of the material surface can be created or increased. Therefore, a coating formation technique such as a ceramic-spray forming is applied to numerous technical field such as aviation, nuclear energy and semiconductors. In these coating formation techniques, particularly when a material having high melting point is sprayed on a surface of a metallic material, plasma spraying is utilized in which a plasma arc or a plasma jet having high heat energy is a heat reservoir. The plasma spraying is a method in which an arc is generated between an anode and a cathode, and melted material is jetted out to the exterior with carrier gas by a nozzle. As the carrier gas, a gas in which hydrogen or nitrogen is mixed with argon gas is generally utilized in addition to inert gases such as argon gas or helium gas.

As mentioned above, electrical insulation and corrosion resistance in various sprayed coatings formed by the plasma spraying are inferior to those in sintered compacts obtained by sintering the same material. This is because many vacancies are in the sprayed coating and the sprayed coating has oxygen defects.

Therefore, techniques, in which the size and number of vacancies is decreased, whereby the sprayed coating is densified, are variously proposed. In these techniques, for example, a method in which plasma spraying is performed on fine powder under reduced pressure, whereby the sprayed coating is densified is proposed (for example, see Japanese Laid-Open Patent Publication No. HEI 10-226869 (pages 4 and 5, and FIG. 1)).

In the method described in the above patent document, sprayed coating can be densified. However, the condition of the oxygen defects of the sprayed coating cannot be suppressed because plasma spraying is performed under reduced pressure. When the sprayed coating which has oxygen defects is utilized in a sprayed-coating portion formed inside the semiconductor processing device, the sprayed coating is a semiconductor during use of the semiconductor processing device, whereby volume resistivity of the sprayed coating is decreased. Accordingly, in this case, excellent electrical insulation cannot be obtained. Moreover, the condition of the oxygen defects is more unstable thermodynamically than the condition of the stoichiometric composition, whereby the sprayed coating is highly reactive in the utilization of the semiconductor processing device, resulting in being poor in corrosion resistance. Therefore, recently, development of production techniques for sprayed coatings, in which the above-mentioned problem in the oxygen defects is solved, whereby excellent electrical insulation and corrosion resistance can be simultaneously obtained, is desired.

SUMMARY OF THE INVENTION

The present invention was made in consideration of the above desire, and an object of the present invention is to provide a sprayed coating, in which the above-mentioned problems in the oxygen defects are solved, whereby excellent electrical insulation and corrosion resistance can be simultaneously obtained, and to provide a production method for the same.

The inventors of this invention have extensively researched the sprayed coating in order to solve the above problems concerning the condition of the oxygen defects, and have completed the present invention by finding that the above problem can be solved by setting the composition of the sprayed coating to be a stoichiometric composition or a composition about equal to the stoichiometric composition, whereby excellent electrical insulation and corrosion resistance of the sprayed coating can be simultaneously obtained. Furthermore, the inventors of this invention have completed the present invention by finding that when the composition of the sprayed coating is brought close to the stoichiometric composition, it is effective to use oxygen gas instead of using a reducing gas which is conventionally used as a plasma operating gas. The present invention was made based on these findings.

The sprayed coating of the present invention is a sprayed coating which is formed by a plasma spraying inside a semiconductor processing device, and the sprayed coating is made of metal oxide or semiconductor oxide, and the composition ratio of oxygen with respect to metal or semiconductor which is composed of oxides, that is (oxygen/(metal or semiconductor)) is at not less than 80% of a composition ratio in the case of the stoichiometric composition.

In the sprayed coating of the present invention, as mentioned above, composition ratio of oxygen to metal or semiconductor which is composed of oxides, that is (oxygen/(metal or semiconductor)) is at not less than 80% of a composition ratio in the case of stoichiometric composition, so as to bring the composition of the sprayed coating close to a stoichiometric composition or a composition about equal to the stoichiometric composition. Therefore, when the sprayed coating of the present invention is utilized in a sprayed-coating portion formed inside the semiconductor processing device, a phenomenon in which the sprayed coating forms a semiconductor during the use of the semiconductor processing device is suppressed, whereby volume resistivity of the sprayed coating can be decreased, resulting in obtaining excellent electrical insulation. Moreover, oxygen defects being present in the sprayed coating can be avoided, whereby the sprayed coating can be in a thermodynamically stable condition. Therefore, reactivity in the utilization of semiconductor processing device can be decreased, resulting in obtaining excellent corrosion resistance.

As a metal or oxide which is a component of the sprayed coating, metal or semiconductor which has conventionally been a component of metal oxide or semiconductor oxide can be used, and for example, at least one kind of an alkaline-earth metal, a rare-earth metal, Al, Ta, and Si can be accordingly selected in view of the uses.

Moreover, a production method for a sprayed coating of the present invention is a method in which a sprayed coating formed by plasma spraying inside a semiconductor processing device is preferably produced, and plasma operating gas is an oxygen gas or a gas including oxygen.

In a semiconductor production process, corrosion resistance of a sprayed coating formed by plasma spraying inside a semiconductor processing device can be judged by reactivity between the sprayed coating and plasma or plasma gas (generally, a fluoride reaction by fluorine plasma), and by stability of the reaction layer (generally, fluoride layer) formed on the surface of the sprayed coating. When the composition of the sprayed coating is a stoichiometric composition, for example, a fluoride reaction between the sprayed coating and fluorine plasma is progressed over approximately the entire area of the sprayed coating. On the other hand, when the composition of sprayed coating is a non-stoichiometric composition, that is, a condition of oxygen defects, the fluoride reaction is not uniformly progressed. Generally, a sprayed coating obtained by plasma spraying demonstrates non-stoichiometric composition in which a condition of oxygen defect is expressed. This phenomenon dominantly occurs when reducing gas or inert gas is used as plasma operating gas in spraying. In order to increase the corrosion resistance and electrical insulation, it is preferable that the sprayed coating has a composition which is close to a stoichiometric composition to the utmost extent, and that composition ratio of oxygen to metal or semiconductor which is composed of oxides, that is (oxygen/(metal or semiconductor)) is at not less than 80% of a composition ratio in the case of the stoichiometric composition, as mentioned above. In the production method for the sprayed coating of the present invention, the composition of the sprayed coating can be closer to the stoichiometric composition than that of the conventional sprayed coating because plasma operating gas is oxygen gas or a gas including oxygen, whereby excellent electrical insulation and corrosion resistance of the sprayed coating are simultaneously obtained.

In these production methods for sprayed coating, it is preferable that the in which spraying is conducted be air. In the plasma spraying technique described in the patent document, plasma spraying is performed under a reduced pressure. Therefore, it is necessary not only for a vacuum pump to be separately installed in the plasma spraying equipment, but also for the vacuum pump to be operated separately from the plasma operating equipment in the production of the sprayed coating, whereby the production cost of the sprayed coating is increased. On the other hand, in the production method for the sprayed coating of the present invention, it is not necessary to separately install and operate equipment such as a vacuum pump because the atmosphere in which spraying is conducted is air. Accordingly, in the production method for the sprayed coating of the present invention, cost reduction can be realized in the production of the sprayed coating.

EMBODIMENTS

Next, embodiments of the present invention will be described.

Sprayed coating composed by aluminum oxide, magnesium oxide, or yttrium oxide was respectively produced, composition and density of each sprayed coating was measured, and electrical insulation and corrosion resistance of each sprayed coating were tested.

Measurement of Composition and Electrical Insulation of Each Sprayed Coating In a chamber, aluminum oxide, magnesium oxide or yttrium oxide was sprayed from a spraying device by using each plasma operating gas, as shown in Table 1, on the upper surface of an aluminum stage of 30 mm×30 mm×5 mm, whereby each sprayed coating of 30 mm×30 mm×350 μm (Practical Examples 1 to 5 and Comparative Examples 1 to 3) was produced. Additionally, the atmosphere in which spraying was conducted was air. Next, in each sprayed coating, the composition ratio of oxygen to aluminum, magnesium or yttrium (oxygen/aluminum, magnesium or yttrium) was measured by ESCA (Electron Spectroscopy for Chemical analysis), and percentages of actual composition ratio (experimental value) to stoichiometric composition ratio (stoichiometoric composition value) was calculated. Moreover, density of the each sprayed coating was measured by Archimede's method (underwater weight measurement). The results mentioned above will be also given in Tables 1 to 3.

TABLE 1

| | | in the case of aluminum | | | |
|---|---|---|---|---|---|
| | plasma operating gas | composition ratio of oxygen to aluminum (experimental value) | composition ratio of oxygen to aluminum (stoichiometric composition value) | percentages of experimental value to stoichiometric composition value (%) | density ($g/cm^3$) |
| Practical Example 1 | $O_2$ | 1.44 | 1.5 | 96 | 3.47 |
| Practical Example 2 | $O_2 + N_2$ | 1.27 | 1.5 | 85 | 3.56 |
| Comparative Example 1 | $Ar + H_2$ | 1.19 | 1.5 | 79 | 3.30 |

TABLE 2

| | in the case of magnesium | | | | |
|---|---|---|---|---|---|
| | plasma operating gas | composition ratio of oxygen to magnesium (experimental value) | composition ratio of oxygen to magnesium (stoichiometric composition value) | percentages of experimental value to stoichiometric composition value (%) | density ($g/cm^3$) |
| Practical Example 3 | $O_2$ | 0.92 | 1.0 | 92 | 3.09 |
| Practical Example 4 | $O_2 + N_2$ | 0.81 | 1.0 | 81 | 3.06 |
| Comparative Example 2 | $Ar + H_2$ | 0.71 | 1.0 | 71 | 2.96 |

TABLE 3

| | in the case of yttrium | | | | |
|---|---|---|---|---|---|
| | plasma operating gas | composition ratio of oxygen to yttrium (experimental value) | composition ratio of oxygen to yttrium (stoichiometric composition value) | percentages of experimental value to stoichiometric composition value (%) | density ($g/cm^3$) |
| Practical Example 5 | $O_2$ | 1.27 | 1.5 | 85 | 4.82 |
| Comparative Example 3 | $Ar + H_2$ | 1.13 | 1.5 | 75 | 4.71 |

As shown in Tables 1 to 3, in the percentages of experimental value to stoichiometric composition value, when the same kind of sprayed coatings were compared, the values of sprayed coatings in Practical Examples 1, 3, and 5 in which $O_2$ was used as the plasma operating gas were the highest, the values of sprayed coatings in Practical Examples 2 and 4 in which $O_2$+$N_2$ was used as plasma operating gas were next high, and the values of sprayed coatings in Comparative Examples 1 to 3 in which Ar+$H_2$ was used as plasma operating gas were lowest. Accordingly, it was demonstrated in the percentages of experimental value to stoichiometric composition value that when oxygen gas or a gas including oxygen was used as a plasma operating gas according to the present invention, higher values were obtained. Moreover, as shown in Table 1 to 3, in the density, when the same kind of sprayed coatings were compared, the values of sprayed coatings in Practical Examples 1 to 5 in which $O_2$ or $O_2$+$N_2$ was used as plasma operating gas were higher than those in Comparative Example 1 to 3 in which Ar+$H_2$ was used as plasma operating gas. Accordingly, it was also confirmed in the density that when oxygen gas or a gas including oxygen was used as a plasma operating gas according to the present invention, higher values were obtained.

Tests of Electrical Insulation

Carbon electrodes having 20 mm diameter was respectively set on the upper surface of sprayed coating in each Practical Example and each Comparative Example in which the percentages of experimental value to stoichiometric composition value and density was confirmed. Next, DC5 kV of voltage was applied between the electrode and the stage. Under such conditions, the presence of dielectric breakdown of the sprayed coating by sparks was tested. The results mentioned above will be also given in Table 4.

TABLE 4

| | material of sprayed coating | plasma operating gas | presence of dielectric breakdown in the case of applying DC5 kV between electrode having 20 mm diameter and stage |
|---|---|---|---|
| Practical Example 1 | aluminum oxide | $O_2$ | none |
| Practical Example 2 | | $O_2 + N_2$ | none |
| Comparative Example 1 | | $Ar + H_2$ | present |
| Practical Example 3 | magnesium oxide | $O_2$ | none |
| Practical Example 4 | | $O_2 + N_2$ | none |
| Comparative Example 2 | | $Ar + H_2$ | present |
| Practical Example 5 | yttrium oxide | $O_2$ | none |
| Comparative Example 3 | | $Ar + H_2$ | present |

As shown in Table 4, it was confirmed that dielectric breakdown did not occur in each sprayed coating of the Practical Examples 1 to 5. This is because when the voltage of DC5kV was applied between the carbon electrode and the stage, volume resistivity was not decreased because percentages of the experimental value to stoichiometric composition value were high and the density was comparatively high. On the other hand, it was confirmed in the sprayed coatings of the Comparative Examples 1 to 3 that dielectric breakdown occurred. This is because volume resistivity was decreased because percentages of the experimental value to stoichiometric composition value and density were low.

Corrosion Fatigue Testing by Reactive Ion Etching (RIE)

A reactive ion etching by using $CHF_3$ gas was performed for 2 hours with each sprayed coating (30 mm×30 m×350 μm) of the Practical Examples 1 to 5 and Comparative Examples 1 to 3. Concretely, a masking treatment was performed with a portion of sprayed coating, and a portion in which etching treatment was performed and another portion in which etching treatment was not performed were set. Furthermore, after the corrosion fatigue testing by RIE, shape of the surface of the sprayed coating was measured, degree of the corrosion per hour of a portion in which masking was not performed, that is, etching was performed, to a masking portion was calculated as the etching rate. The results mentioned above will also be given in Table 5. Additionally, all amounts of the corrosion were calculated as "etching rate×2" of each sprayed coating.

TABLE 5

| | material of sprayed coating | plasma operating gas | etching rate by fatigue testing (μm/hr.) |
|---|---|---|---|
| Practical Example 1 | aluminum oxide | $O_2$ | 0.80 |
| Practical Example 2 | | $O_2 + N_2$ | 0.88 |
| Comparative Example 1 | | $Ar + H_2$ | 1.71 |
| Practical Example 3 | magnesium oxide | $O_2$ | 0.42 |
| Practical Example 4 | | $O_2 + N_2$ | 0.50 |
| Comparative Example 2 | | $Ar + H_2$ | 1.25 |
| Practical Example 5 | yttrium oxide | $O_2$ | 0.75 |
| Comparative Example 3 | | $Ar + H_2$ | 1.44 |

According to the Table 5, when the same kind of the sprayed coating was compared, the values of etching rate of sprayed coatings in Practical Examples 1 to 5 in which $O_2$ or $O_2$+$N_2$ was used as plasma operating gas were lower than those in Comparative Examples 1 to 3 in which Ar+$H_2$ was used as plasma operating gas, whereby corrosion resistance in Practical Examples 1 to 5 were superior to those in Comparative Examples 1 to 3.

What is claimed is:

1. A sprayed coating formed by plasma spraying inside a semiconductor processing device, the coating comprising:

a metal oxide composed of oxygen and a metal, or a semiconductor oxide composed of oxygen and a semiconductor;

wherein a composition ratio of the oxygen with respect to the metal or the semiconductor is not less than 80% of a composition ratio of the stoichiometric composition.

2. The sprayed coating according to claim 1, wherein the metal or the semiconductor comprises at least one of an alkaline-earth metal, a rare-earth metal, Al, Ta, and Si.

3. The sprayed coating according to claim 1, wherein the metal oxide is aluminum oxide and a percentage of actual composition ratio to stoichiometric composition ratio is not less than 85%.

4. The sprayed coating according to claim 1, wherein the metal oxide is magnesium oxide and a percentage of actual composition ratio to stoichiometric composition ratio is not less than 81%.

5. The sprayed coating according to claim 1, wherein the metal oxide is yttrium oxide and a percentage of actual composition ratio to stoichiometric composition ratio is not less than 85%.

* * * * *